US005628126A

United States Patent [19]

North

[11] Patent Number: 5,628,126

[45] Date of Patent: May 13, 1997

[54] REVOLVING DRUM DRYING APPARATUS AND METHOD

[75] Inventor: Roger D. North, Exeter, Great Britain

[73] Assignee: Stephen Manton North, Great Britain

[21] Appl. No.: 956,006

[22] PCT Filed: Jan. 5, 1991

[86] PCT No.: PCT/GB91/00896

§ 371 Date: Jan. 13, 1994

§ 102(e) Date: Jan. 13, 1994

[87] PCT Pub. No.: WO91/19145

PCT Pub. Date: Dec. 12, 1991

[30] Foreign Application Priority Data

Jun. 5, 1990 [GB] United Kingdom ..... 9012463

[51] Int. Cl.[6] ..... F26B 11/02

[52] U.S. Cl. ..... 34/599; 34/135; 34/137; 432/105

[58] Field of Search ..... 34/135, 137, 599; 432/105

[56] References Cited

U.S. PATENT DOCUMENTS

| | | | |
|---|---|---|---|
| 2,872,386 | 2/1959 | Aspegren . | |
| 4,094,633 | 6/1978 | Peterson et al. | 432/118 |
| 4,474,553 | 10/1984 | Takahashi | 432/27 |

*Primary Examiner*—Henry A. Bennett
*Assistant Examiner*—Siddharth Ohri
*Attorney, Agent, or Firm*—Ira S. Dorman

[57] ABSTRACT

Apparatus for drying a wet material such as sewage sludge comprises a drum (11) mounted for revolution about a horizontal axis and containing interconnected inner (22) and outer (21) concentric spirals containing a continuously-recirculatable charge of particulate heat exchange/pulverizing medium in each coil of the spirals. Sludge is introduced at one end and mixed with the heated charge; the charge and sludge traverse the length of the drum together through the outer spiral while drying takes place; the dried material is removed at the other end and the charge transferred to the inner spiral for transmission to the first end while re-heating takes place by ducted heated air.

11 Claims, 3 Drawing Sheets

REVOLVING DRUM DRYING APPARATUS AND METHOD

This invention relates to a method of drying and to drying apparatus, in particular for drying wet materials in suspension, slurry or sludge form, for example sewage, industrial effluent and the like and also certain granular materials. The invention may also be applied to the cooling of materials.

According to the invention, apparatus for drying wet materials comprises a drum mounted for revolution about a substantially horizontal axis, the drum having inlet means for material to be dried and outlet means for dried material, characterised in that the drum includes inner deflecting wall means defining a spiral pathway having a plurality of coils between the said inlet and outlet means with concentric inner and outer oppositely-handed spirals interconnected at their ends, the drum in use containing a charge of a solid heat exchange and pulverising medium in particulate form, the drum also including means to heat the said medium and means to vent vapours from within.

The invention also includes a method for drying a wet material, the method comprising introducing the material into a revolvable drum having a substantially horizontal axis of revolution and containing a heated solid heat exchange and pulverising medium in particulate form and revolving the drum to mix the material and the heat exchange medium, the drum having inner deflecting wall means defining a spiral pathway having a plurality of coils with concentric inner and outer oppositely-handed spirals interconnected at their ends between the said inlet and outlet means, whereby the material and heat exchange medium are contained within the pathway and propelled axially of the drum while drying takes place, vapours being vented from within the drum, separating the dried and pulverised material from the heat exchange and pulverising medium and removing the said dried and pulverised material from the drum and recirculating the pulverising medium.

Throughout the remainder of this specification, including the claims, the invention will be described with reference to the drying of a wet material. However, it is to be understood that the invention may be equally applicable to cooling, with or without drying, and accordingly any references to "heating", "drying", "dried materials" and so on are to be taken as including cooling and cooled material as the context requires. In place of heated air as a heating means, a cooled gas, sublimed carbon dioxide or the gas formed from the boiling of a cryogenic liquid may be used as cooling means.

In the apparatus according to the invention, the inner deflecting wall means is preferably fixed in relation to the drum outer wall whereby the inner surface of the said wall forms the floor of the pathway. In use, the contents of the drum are caused by gravity, on rotation of the drum, to remain in the lower portion of each coil of the spiral pathway and thereby to traverse the length of the drum as rotation continues. The heat exchange and pulverising medium is preferably recirculated from the outlet to the inlet end of the drum with re-heating, following separation of the dried material, whereby the process operates continuously with each successive coil containing a discrete charge of heat exchange and pulverising medium and material undergoing drying.

The interior of the drum comprises concentric inner and outer oppositely-handed spirals in communication at their ends, whereby on rotation of the drum the charge re-circulates through the spirals, material to be dried being introduced through the inlet means at one end and dried material being discharged through the outlet means at the other end, the material or a major part thereof making a single pass through one of the spirals, preferably the outer spiral. Conveniently, the heat exchange and pulverising medium is heated and re-heated during its return passage through the other one of the spirals, preferably the inner spiral, between the outlet and inlet means for dried material and for material to be dried, respectively. At the inlet means end, a discrete charge of medium is ejected from the end of the inner spiral at each complete revolution and falls under gravity to the beginning of the outer spiral, the ends of the respective spirals preferably being substantially in radial registration with each other to ensure clean uptake of each discrete charge by each respective coil of the outer spiral. At the outlet means end, the floor of the spiral pathway preferably gradually assumes a progressively smaller radius to lift the medium to transfer it from the outer to the inner spiral.

The heating means for the heat exchange and pulverising medium may conveniently be a perforated pipe or tube mounted centrally within the drum and arranged to duct heated air therein. Exhaust air may be vented through the vent means together with vapours from the material undergoing drying. The heated air may itself directly assist in the drying operation. In an alternative arrangement, the heating means may comprise an annular perforate chamber between the inner and outer spirals, the heated air being preferably introduced at one end and at the lower region of the chamber, the other end being closed, the chamber including divider or baffle means, for example disposed radially, to confine the heated air to the lower part of the annular chamber from where it passes upwardly through the said medium.

The heat exchange and pulverising medium preferably comprises balls formed from a material which is sufficiently hard to provide the required pulverising action and which has a heat capacity whereby it attains the desired temperature during initial heating or re-heating and retains an elevated temperature while losing heat to the material to be dried. For most purposes, steel or stainless steel is a suitable material although ceramic materials such as steatite may also be used. The size of the balls and the amount of the charge is chosen according to the dimensions of the drum, the properties, for example viscosity, solids content, of the material to be dried, or other operating parameters.

It will be understood that, in the preferred concentric spirals arrangement, a charge of heat-exchange and pulverising medium is placed in the lower part of each successive coil of the spirals, whereby on rotation of the drum there is a continuous longitudinal progressive movement of medium in one direction along the drum, through the outer spiral, and in the reverse direction through the inner spiral. As the drum rotates, the medium tends to be drawn in the direction of rotation up the side of the drum until gravity causes it to slip back, whereby, particularly in the presence of material to be dried, the medium describes a constant churning or tumbling motion within the spiral path. Optionally, this may be enhanced by providing vanes, paddles or other deflecting elements on the sides and/or the base of the spirals, to increase the agitation of the medium and hence the pulverising effect and to minimise build-up within the drum of caked sludge or other material to be dried. Alternatively, this object could be met by including straight-edged elements within the charge to act as scrapers. In the smaller-diameter inner spiral, the medium naturally is constrained to accummulate together to a greater extent than in the larger-diameter outer spiral and this assists in efficient heat transfer from the heated air. The pitch of the spirals is preferably enlarged where the heat exchange and pulverising medium is transferred from the outer to the inner spiral, to prevent or minimize the build-up of an accumulation of said medium with resulting potential for blockage.

The inlet and outlet means for the material to be dried, which is preferably pre-macerated, and for the dried material respectively preferably comprise ports which are connected to the drum via revolvable glands. The inlet means may be constituted by a charging hopper and screw conveyor to an inlet duct which passes through an end wall of the drum via a revolvable gland, and the outlet means may be constituted by a perforate, mesh, or grid-like base to the spiral pathway at the other end of the drum, whereby dried material passes through into a covered receiving hopper for further processing in, for example, a briquette-forming device, and the heat exchange and pulverising medium is retained for re-circulation. Preferably, the inlet means includes a gas seal and the cover of the receiving hopper surrounds the drum, to minimize undesirable losses of heating air. The receiving hopper may be subject to reduced pressure within, to assist removal of the dried material by suction.

In order for the heating air to assist in the drying process, some of the air may be passed through the outer spiral, for example in contra-flow to the direction of movement of the material being dried, whereby moisture vapour in the dryer parts of the spiral are back-flushed to the wetter parts.

The invention is suitable for use as part of a processing plant for sewage, household or industrial organic effluent containing grease and fatty substances, and the like, the plant also including filters, incinerators, furnaces for end-product material, cyclones, condensers and other treatment means as required. Combustion of the end-product material may provide heated air for the inventive process, thereby increasing its energy efficiency.

Embodiments of the invention will now be described by way of example with reference to the accompanying drawings, of which FIG. 1 shows a cross-sectional side view of drying apparatus FIG. 1A is an enlarged fragmentary view inset taken at location "1A" of FIG. 1;

Figures 1, 1A:
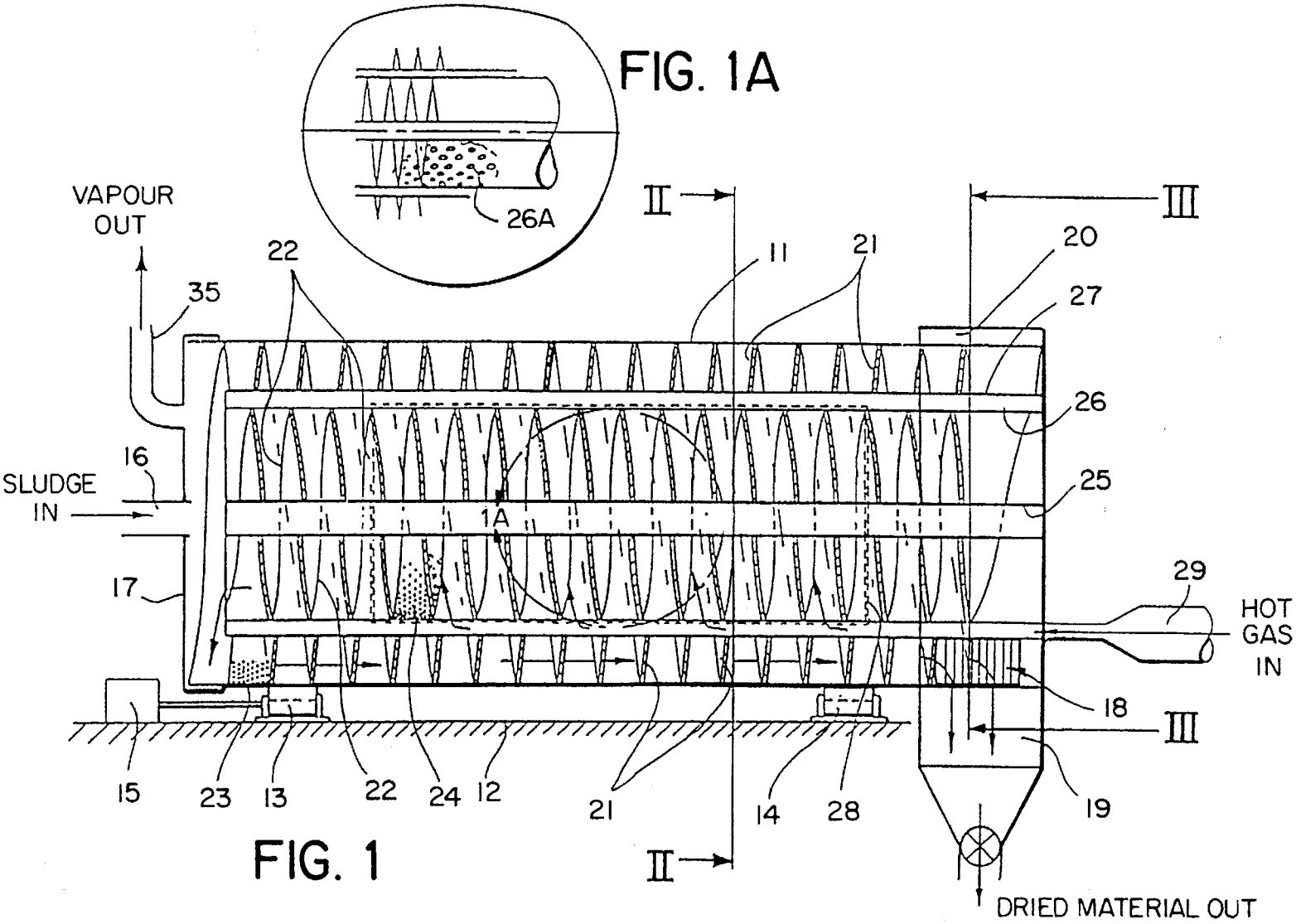

Referring to FIGS. 1 and 1A, the apparatus as shown consists of a drum 11 mounted horizontally on a base 12 via rollers 13 and 14. Rollers 13 are connected to a drive motor 15. A charge hopper (not shown) for material to be dried is connected to a pipe 16 which is in axial communication with the end wall 17 of the drum, for example via a gland; the pipe 16 contains a screw conveyor which, depending on the pitch, may act as a macerator.

At the other end of the drum, the outer circular wall is constituted by a series of grid elements 18 which communicate with the interior of a receiving hopper 19 which sealingly surrounds the screen material by means of a cover 20.

The interior of the drum has deflecting walls which define a pathway constituted by an outer spiral 21 and an inner spiral 22 which are oppositely-handed. Each loop of the spirals contains a charge of steel balls, typically of 25 mm diameter. For clarity, these are shown only in one loop of each respective spiral, at 23 in the outer spiral and at 24 in the inner spiral.

The inner spiral is closed interiorly by a cylindrical axial tube 25. The inner spiral is closed exteriorly by a cylindrical plate 26 which constitutes the inner wall of an annular chamber, the outer wall 27 of which supports the outer spiral flights. The inner plate 26 has perforations 26A (see the inset part of FIG. 1) within the area indicated by the double dashed line 28, for allowing heating air passed in through duct 29 access to the inner spiral while retaining the steel balls therein. At the outlet end of the drum, the pitch of the flights of the inner and outer spirals is doubled compared with the remainder of the coils; this assists removal of dried material and transfer of the medium to the inner spiral.

Figure 2:
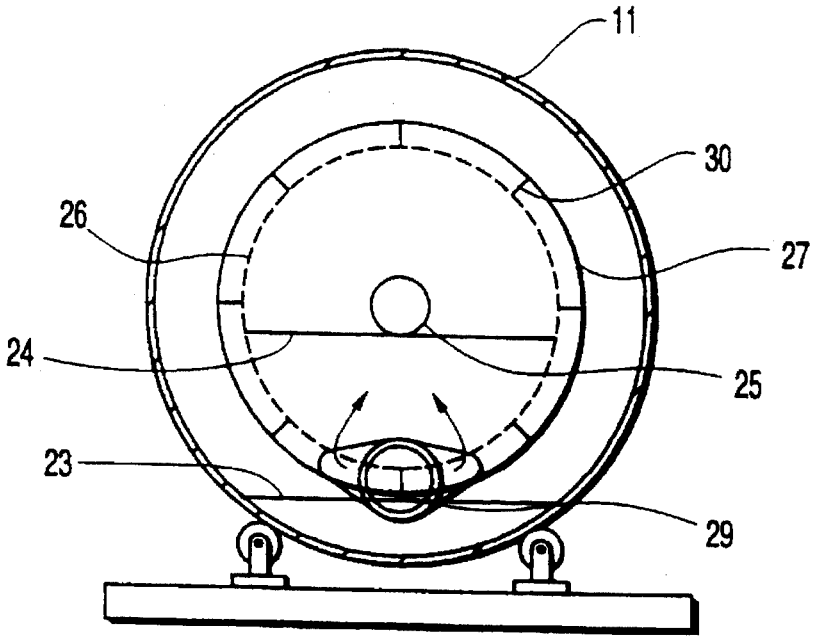
FIG. 2 is a cross section along the line II—II of FIG. 1.

FIG. 2 shows that the annular chamber is sub-divided by radial separators 30 whereby heating air is constrained to flow generally upwardly in the direction of the arrows through the charge as the drum revolves. Also indicated is the ball level in the inner and outer spirals with the drum stationary.

Figure 3:
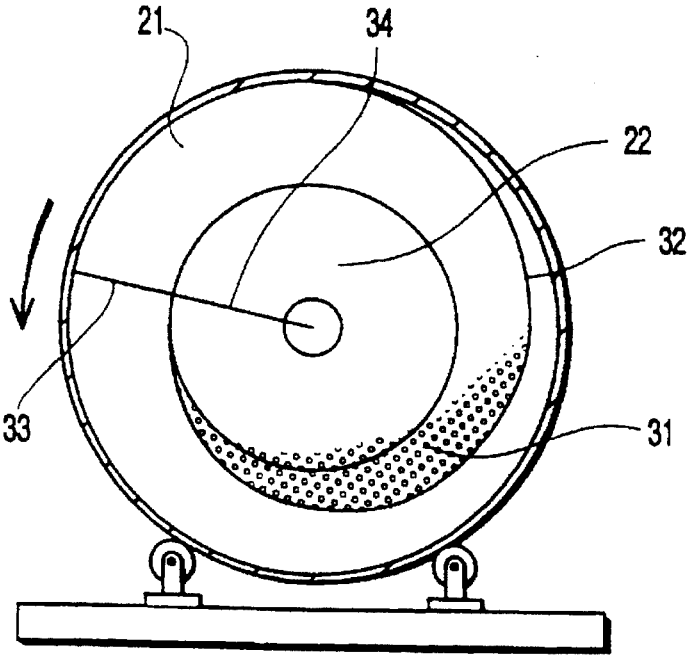
FIG. 3 is a cross section along the line III—III of FIG. 1, excluding the receiving hopper and grid elements.

As shown in FIG. 3, at the end region of the drum within the receiving hopper 19 (not shown in FIG. 3) and on continued rotation thereof in the direction of the arrows, the charge in the respective loops of the outer spiral 21, substantially free of the dried material which has passed through the grid elements 18 (not shown) into the receiving hopper 19, is transferred to the inner spiral 22. On counter-clockwise rotation of the drum, as viewed in FIG. 3, the charge 31 in the outer spiral becomes transferred from the outer spiral to the inner spiral in one revolution, the deflecting wall of the final flight of the outer spiral being provided with a baffle 32 of gradually decreasing radius to constrain the charge inwardly, in conjunction with the inner surface of the end plate, to the entry zone of the first coil of the inner spiral, as shown more clearly in FIG. 4.

Figure 4:
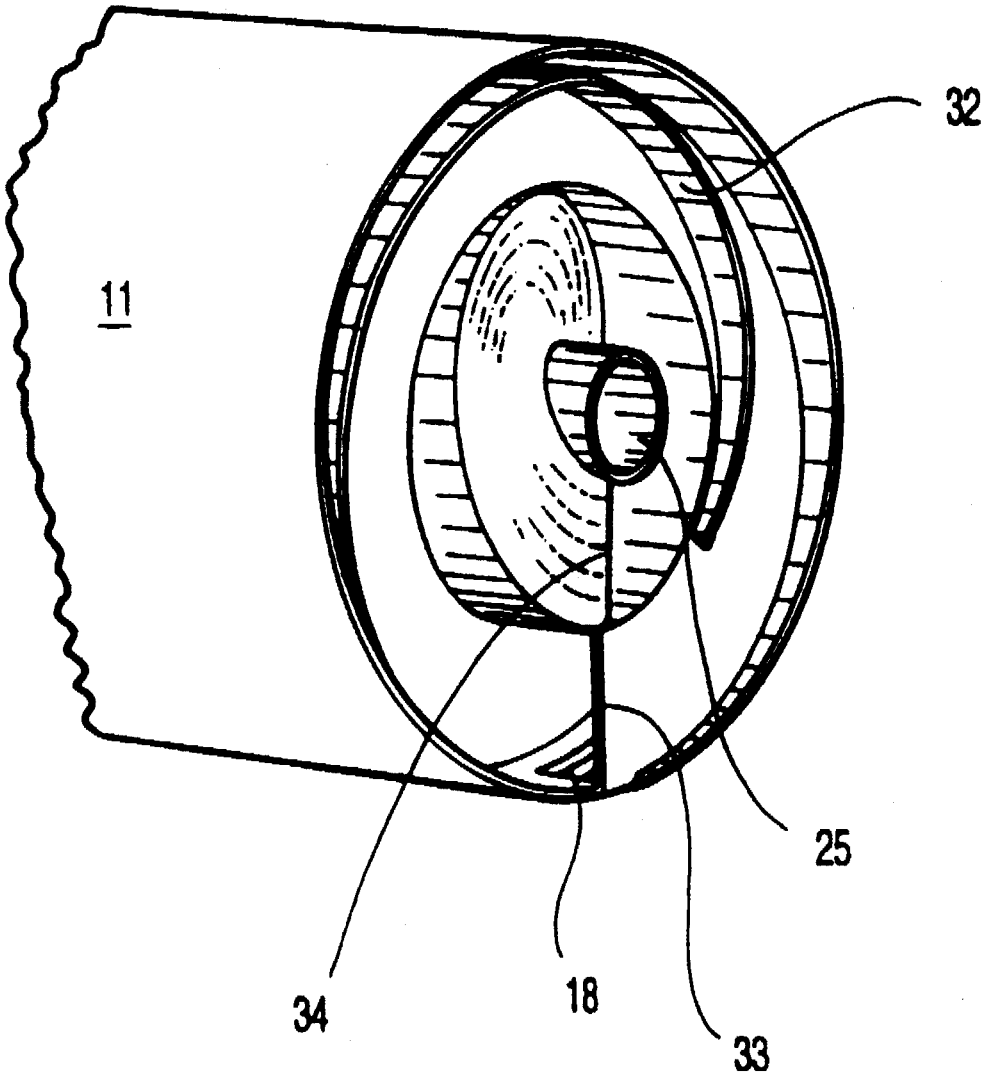
FIG. 4 is a fragmentary perspective representation of the FIG. 3 end of the apparatus with the end plate removed.

In FIGS. 3 and 4, the end of the deflecting wall of the outer spiral is indicated at 33 and the beginning of the deflecting wall of the inner spiral is shown at 34. In FIGS. 3 and 4, the annular chamber 26 is omitted for the sake of clarity.

Once returned to the inner spiral, the medium is propelled back along the inner spiral towards end wall 17, being re-heated by hot gases passing from the annular chamber through the perforations or apertures, until it again passes into the outer spiral 21 and is mixed with fresh incoming material to be dried via pipe 16.

Exhaust gases and vapours are passed through exit duct 35 (FIG. 1) and may be recirculated via a cyclone and condenser to a heater and blower (not shown) for the flushing gas or in part to the feed hopper.

It has been found that the preferred drum rotation speed is up to about 10 r.p.m. Heat input via hot gases may be variable between about $0.25\times10^6$ to $4\times10^6$ Btu/h (approximately equivalent to $0.075\times10^6$ to $1.2\times10^6$W). Sludge having a solids content of from 20–50% may be input at a rate of up to approximately 10 kilo/sec and dried sludge output at a rate of up to approximately 4000 kg/hr, in a drum of length 4 m and external diameter 1.6 m. However, operating parameters may be altered to suit the drum dimensions and the properties, such as solids content, of the material being processed.

I claim:

1. Apparatus for drying wet materials, the apparatus comprising:

a drum mounted for revolution about a substantially horizontal axis, said drum including inlet means for material to be dried, outlet means for dried material, inner deflecting wall means for defining concentric inner and outer oppositely-handed spiral pathways, wherein said inlet and outlet means are at respective ends of said drum and said spiral pathways are interconnected at each said end; and transfer means adjacent one of said ends of said drum for mechanically transferring matter from said outer pathway to said inner pathway:

a charge of a solid heat exchange and pulverizing medium in particulate form located in said pathways, said outlet means being constructed to prevent passage of said medium therethrough, whereby, when in use upon rotation of said drum, said medium charge can continuously circulate within said drum along said inner and outer spiral pathways; and heating means.

2. Apparatus as claimed in claim 1, wherein said drum has an outer wall, and said deflecting wall means defining said outer spiral pathway is fixed in relation to said outer wall of said drum, whereby the inner surface of said drum outer wall forms the floor of said outer pathway.

3. Apparatus as claimed in claim 1 wherein said ends of said respective inner and outer spiral pathways are substantially in radial registration with each other at the end of the drum at which the charge is transferred from the inner to the outer spiral pathway.

4. Apparatus for drying wet materials, the apparatus comprising:

a drum mounted for revolution about a substantially horizontal axis, said drum including inlet means for material to be dried, outlet means for dried material, and inner deflecting wall means defining concentric inner and outer oppositely-handed spiral pathways, wherein said inlet and outlet means are at respective ends of said drum and said spiral pathways are interconnected at each said end such that when in use upon the rotation of said drum a charge of a solid heat exchange and pulverizing medium in particulate form that is located in said pathways can continuously circulate within said drum along said inner and outer spiral pathways, and wherein said outer spiral pathway assumes a progressively smaller radius towards said inner spiral pathway at the end of the drum at which the charge is transferred from the outer to the inner spiral pathway; and heating means.

5. Apparatus as claimed in claim 1, wherein said heating means comprises an axial perforated pipe within said drum and arranged to duct heated air therein.

6. Apparatus as claimed in claim 1 wherein said drum further comprises means for venting a vapor; and wherein said heating means comprises an annular perforated chamber disposed between said inner and outer spiral pathways, means for introduction of heated air being disposed at one end of said chamber.

7. Apparatus as claimed in claim 6, wherein said heated air introduction means is disposed at a lower region of said annular chamber, said chamber including longitudinal baffle means disposed radially.

8. Apparatus as claimed in claim 1, wherein an pitch of said respective spiral pathways is increased at the interconnection zone between the pathways at the end of said drum incorporating said outlet means for dried material.

9. Apparatus as claimed in claim 4, wherein said drum contains a charge of a solid heat exchange and pulverizing medium in particulate form distributed in each of said spiral pathways.

10. A method for drying a wet material, the method comprising introducing the wet material into a drum having an inlet end through an inlet means located at said inlet end, said drum mounted for revolution about a substantially horizontal axis also having an outlet end and having a plurality of coils that form inner and outer spiral pathways, said drum containing a charge of a heated, solid heat exchange and pulverizing medium in a particulate form that is distributed in each coil of said spiral pathways;

revolving said drum about said axis such that the introduced material and said particulate medium are progressively propelled along said drum through one of said inner and outer spiral pathways from the inlet end to the outlet end;

separating and removing the dried introduced material at said outlet end; and returning said particulate medium to said inlet end along the other of said inner and outer spiral pathways.

11. The apparatus of claim 1 wherein said outlet means is adjacent said one end.

* * * * *